US005542872A

United States Patent [19]

Ho

[11] Patent Number: 5,542,872

[45] Date of Patent: Aug. 6, 1996

[54] TRANSMISSION MECHANISM OF A TOY MOTORCYCLE

[76] Inventor: Tsai W. Ho, 8FL., NO. 113, Yu Jen Rd., Taipei, Taiwan

[21] Appl. No.: 378,341

[22] Filed: Jan. 26, 1995

[51] Int. Cl.[6] ..... A63H 17/21

[52] U.S. Cl. ..... 446/440; 446/437; 446/470

[58] Field of Search ..... 446/236, 470, 446/437, 436, 440, 288, 279–281, 284, 462

[56] References Cited

U.S. PATENT DOCUMENTS

| | | | |
|---|---|---|---|
| 5,139,456 | 8/1992 | Chuang | 446/236 X |
| 5,360,367 | 11/1994 | Ho | 446/470 |

FOREIGN PATENT DOCUMENTS

| | | | |
|---|---|---|---|
| 630644 | 6/1936 | Germany | 446/437 |
| 673967 | 4/1939 | Germany | 446/440 |

*Primary Examiner*—Mickey Yu
*Attorney, Agent, or Firm*—Pro-Techtor International

[57] ABSTRACT

A transmission mechanism of a toy motorcycle, having a transmission case, a transmission mechanism, a forward pushing unit, a laterally pushing unit, a lifting unit, a front hood pivotally disposed on a front side of a main body, and two lateral hoods pivotally disposed on two lateral sides of the main body. The transmission case is disposed on a chassis of the main body and the transmission mechanism is disposed in the transmission case. The transmission mechanism includes a power unit, a transmission gear set, a driving wheel and a coaxial cam set. The driving wheel enables the motorcycle to run on the ground. By means of the coaxial cam set, the forward pushing unit, laterally pushing unit and lifting unit in sequence respectively push and pivot the front hood and the lateral hoods forward and laterally to display decorative missiles and lift and rotate the main body of the toy motorcycle.

9 Claims, 7 Drawing Sheets

TRANSMISSION MECHANISM OF A TOY MOTORCYCLE

BACKGROUND OF THE INVENTION

The present invention relates to a transmission mechanism of a toy motorcycle including a front hood which can be pivoted forward to display a decorative missile, two lateral hoods which can be laterally pivoted to display decorative missiles, a lifting unit for lifting and rotating the main body of the toy motorcycle.

Some conventional toy motorcycles are designed with automatically turning function and light and sound-emitting effect. Some other toy motorcycles are designed with multiple special motions. These toy motorcycles all have complicated transmission mechanisms and are manufactured at high cost. As a result, the prices of these toy motorcycles are high and can hardly popularly accepted by general families.

SUMMARY OF THE INVENTION

It is therefore a primary object of the present invention to provide a transmission mechanism of a toy motorcycle, which includes a forward pushing unit for forward pushing a front hood to display a front decorative member, a laterally pushing unit for laterally intermittently pushing two lateral hoods to display two lateral decorative members, whereby the toy motorcycle is able to perform various attractive motions.

It is a further object of the present invention to provide the above transmission mechanism which also includes a lifting unit. The lifting unit is pressed by a pressing cam to lift the main body and a transmission gear set is used to drive the main body to rotate so as to create a motive visual effect.

According to the above objects, the present invention includes a forward pushing unit, a laterally pushing unit and a lifting unit. The forward pushing unit is used to forward push and pivot a front hood to display a front decorative missile. The laterally unit is used to laterally intermittently push and pivot two lateral hoods to display two lateral decorative missiles. While the lifting unit is used to lift and rotate the main body of the toy motorcycle.

The present invention has simple structure and can be easily manufactured at low cost.

The present invention can be best understood through the following description and accompanying drawings, wherein:

BRIEF DESCRIPTION OF THE DRAWINGS

FIG. 6-1 shows the laterally pushing unit in a retracted state;

FIG. 6-2 shows the laterally pushing unit in an extending state;

FIG. 6-3 is a perspective view showing the first laterally pushing member of the laterally pushing unit; and FIG. 6-4 is a perspective view showing the second laterally pushing member of the laterally pushing unit.

DETAILED DESCRIPTION OF THE PREFERRED EMBODIMENT

Figure 1:
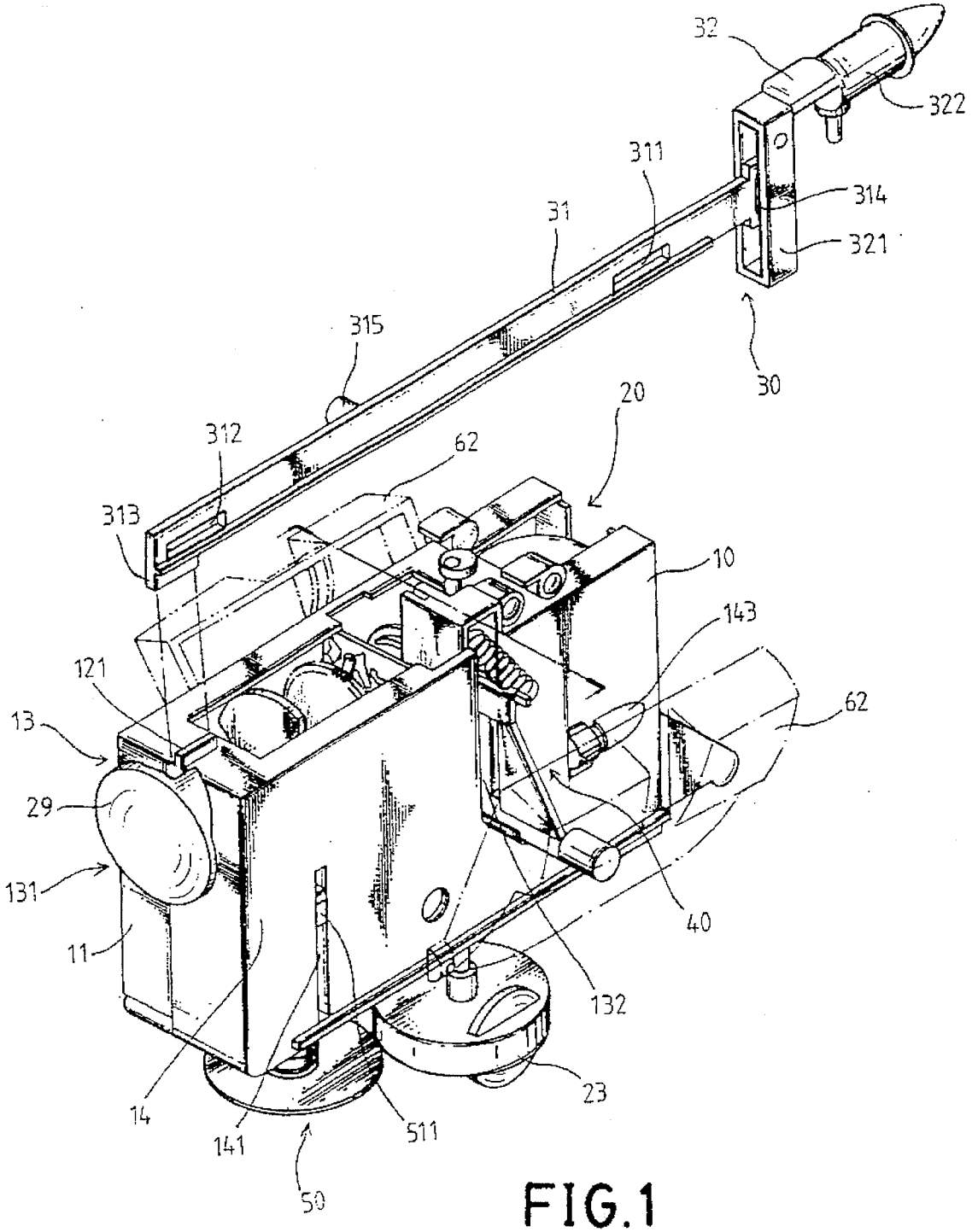
FIG. 1 is a perspective view of the present invention.
Figure 2:
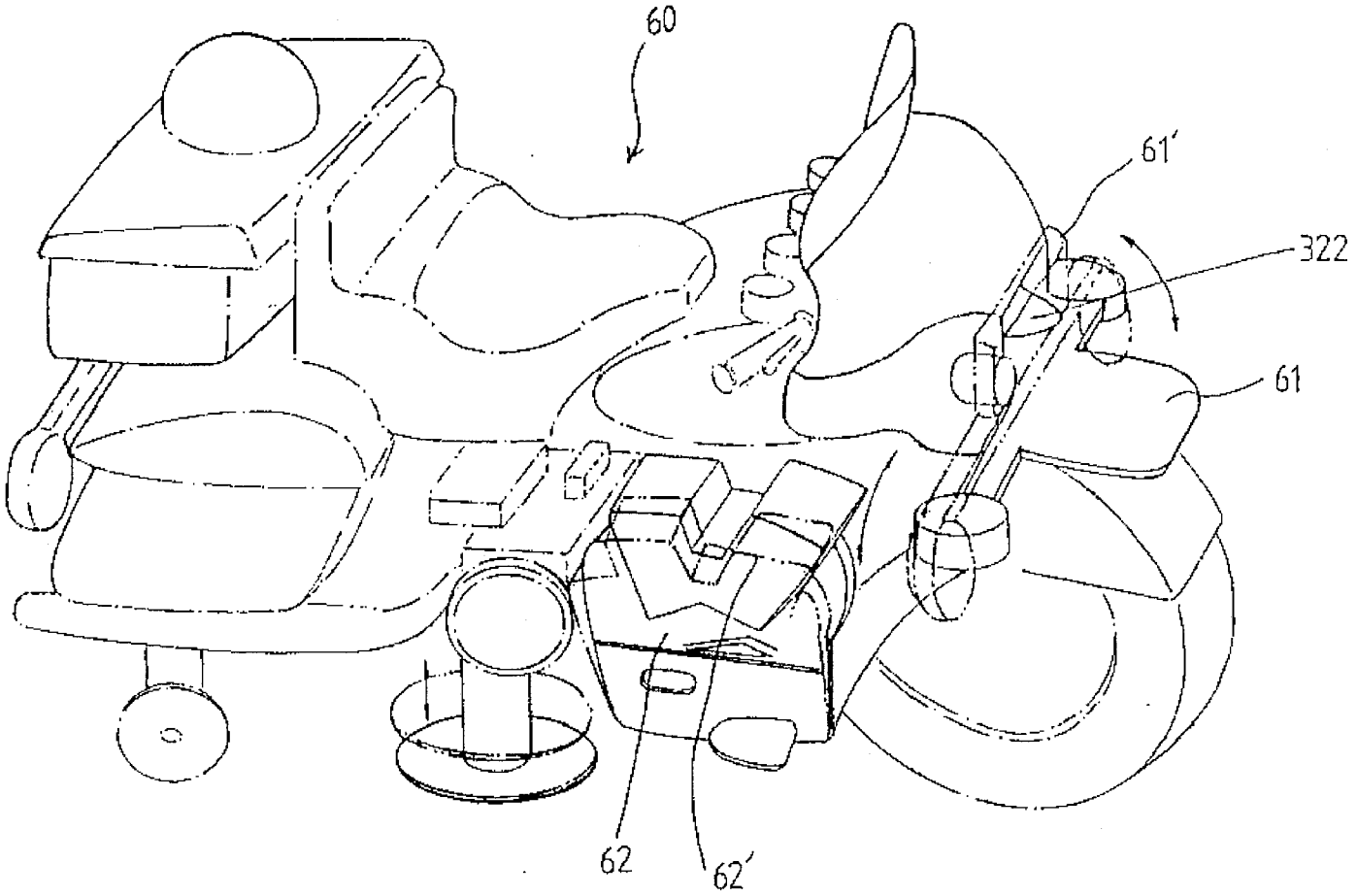
FIG. 2 shows the main body of the toy motorcycle to which the present invention is applied and the motions thereof.

Please refer to FIGS. 1, 3, 4 and 5. The present invention mainly includes a transmission case 10, a transmission mechanism 20, a forward pushing unit 30, a laterally pushing unit 40, a lifting unit 50, a front hood 61 pivotally disposed on a front side of a main body 60, and two lateral hoods 62 pivotally disposed on two lateral sides of the main body 60.

Figure 3:
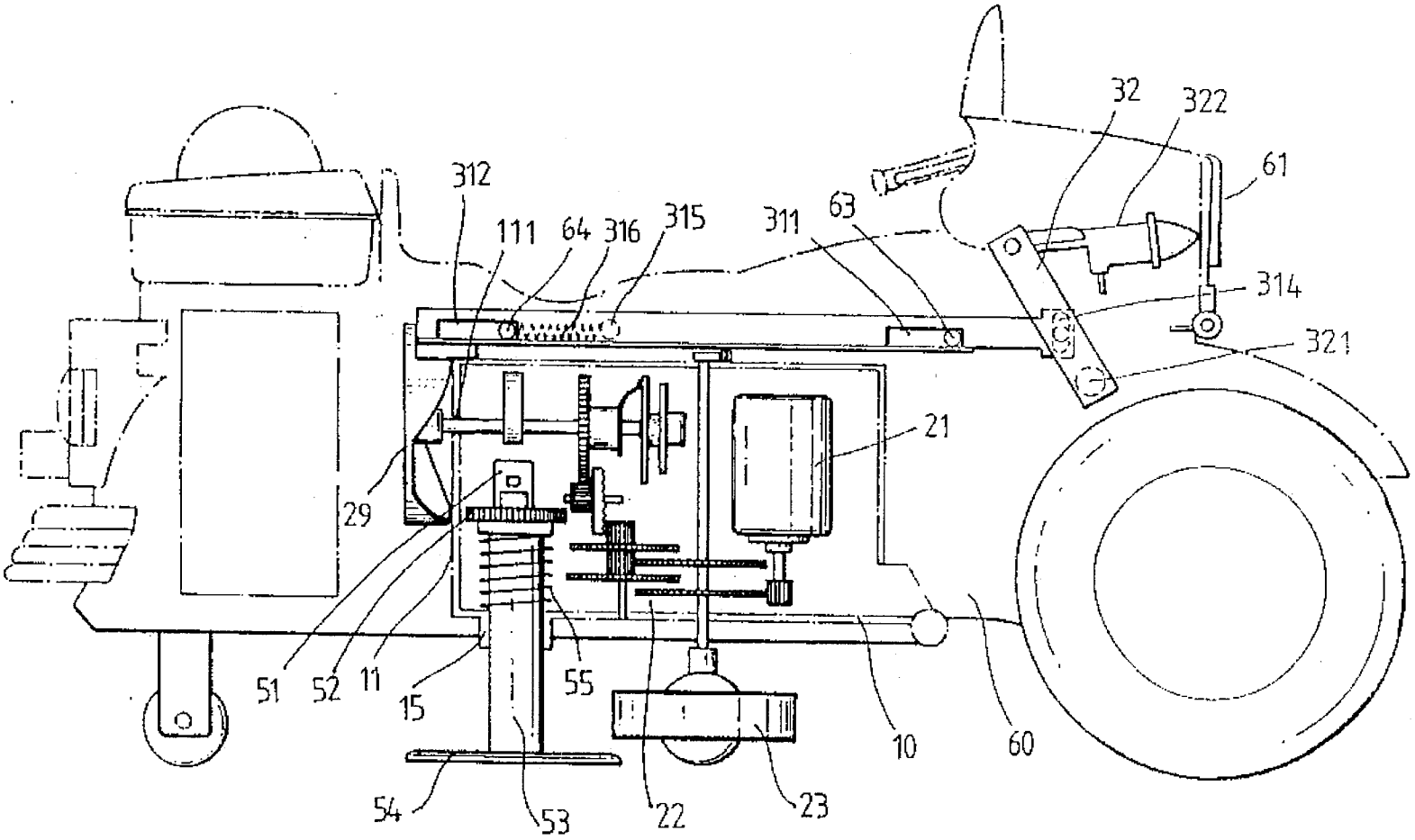
FIG. 3 is a side view showing the transmission mechanism of the present invention located in the main body.
Figure 4:
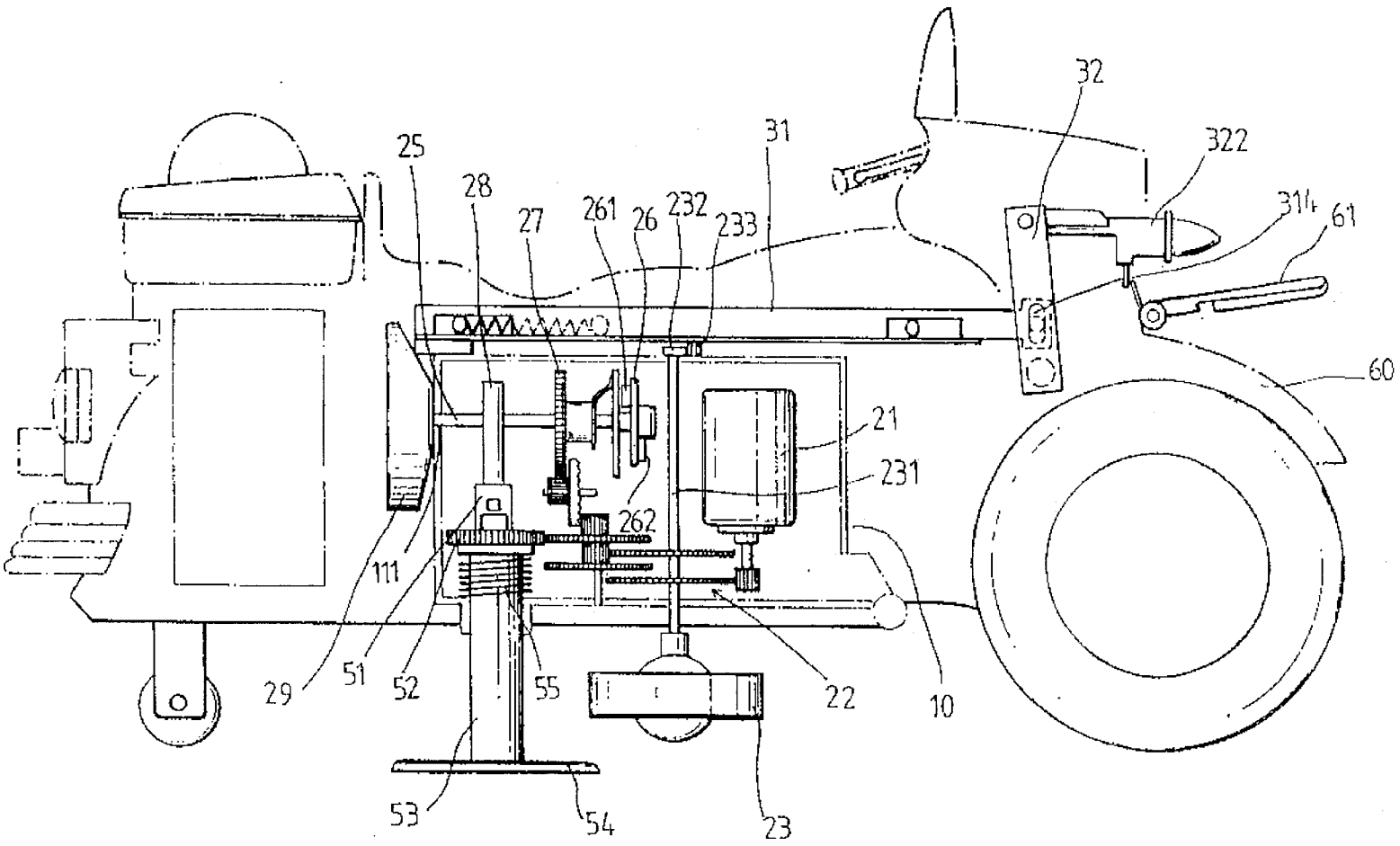
FIG. 4 is a side view according to FIG. 3, showing the motions of the transmission mechanism.
Figure 5:
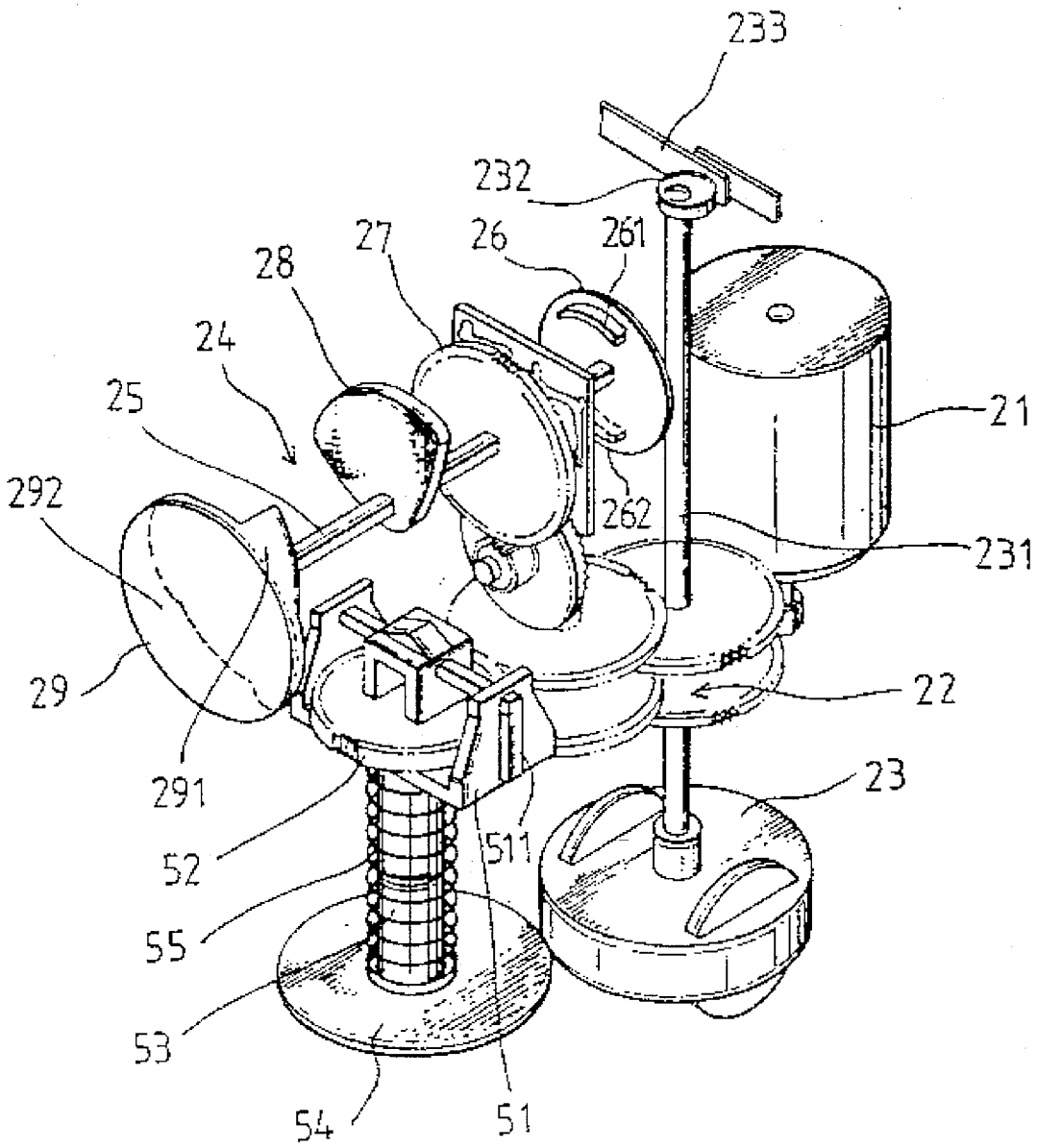
FIG. 5 is a perspective view of the transmission mechanism of the present invention.
Figure 6B:
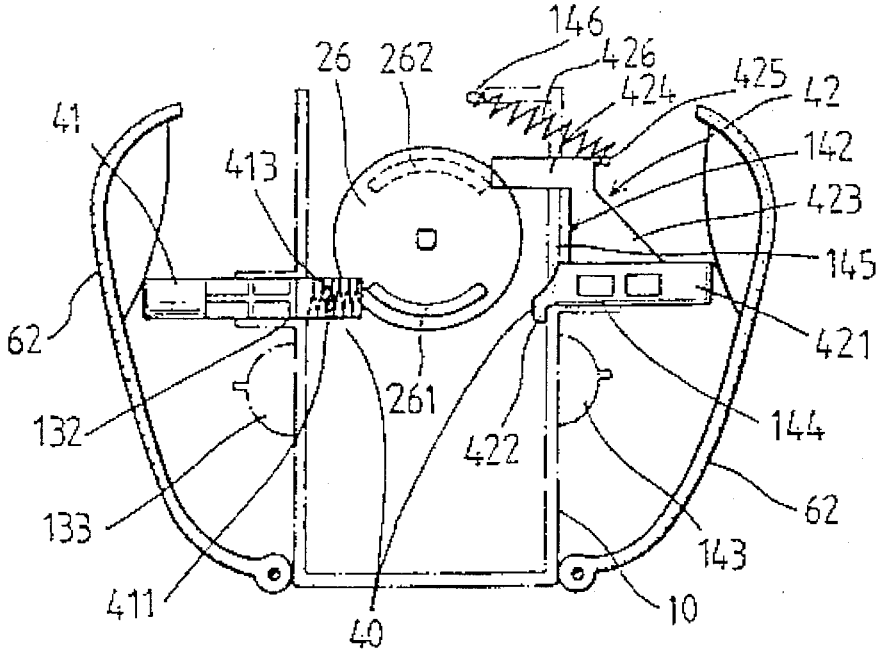
Figure 6A:
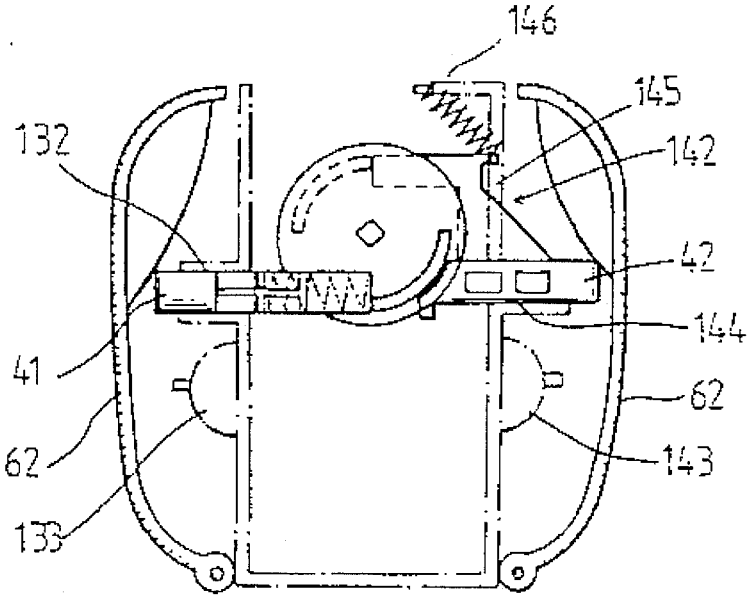
Figure 6C:
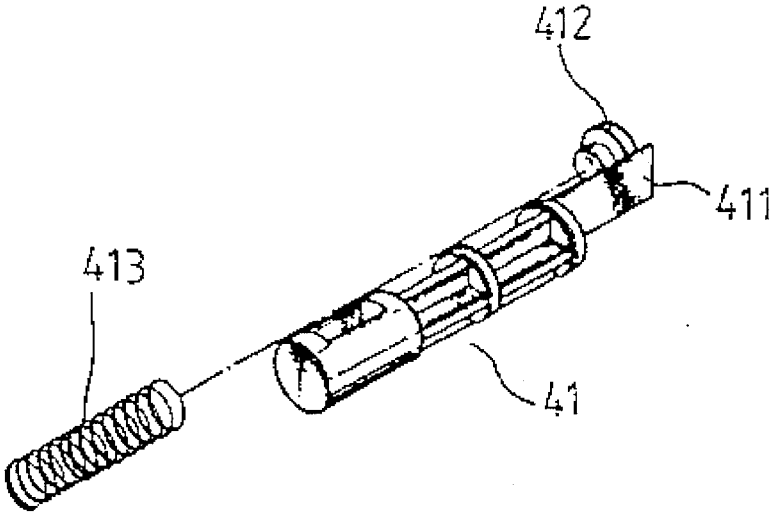
Figure 6D:
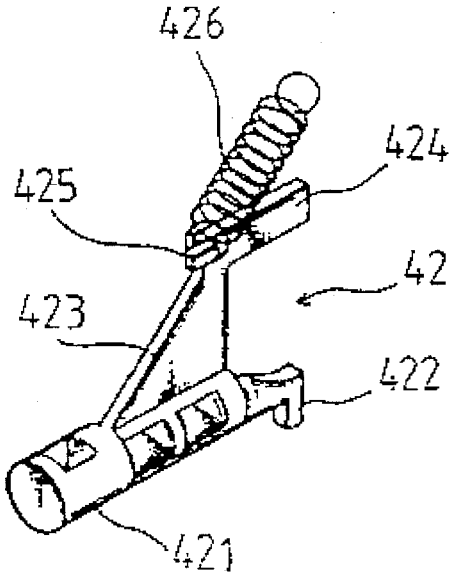

The transmission case 10 is disposed on a chassis of the main body 60 as shown in FIGS. 3 and 4 and the transmission mechanism 20 is disposed in the transmission case 10. A bearing hole 111 is formed on a rear wall 11 of the case 10. A guiding rib 121 is disposed on a rear section of a top wall 12. Two guiding slots 131, 141 are symmetrically disposed on rear sections of two lateral walls 13, 14 for guiding the lifting unit 50. A notch 142 is formed on middle section of the lateral wall 14 and a through hole 132 is formed on middle section of the lateral wall 13 for the laterally pushing unit 40 to extend therethrough. Two decorative members 133, 143 ( which are missiles in this embodiment) are disposed on the lateral walls 13, 14 in front of the notch 142 and through hole 132. The notch 142 has an outward extending rest portion 144 at bottom end, a middle guiding slot 145 and a hook portion 146 at top end, while the through hole 132 has an outward extending hub 13 opposite to the rest portion 144. A through hole 15 is additionally formed on a bottom wall for the lifting unit 50 to extend therethrough.

The transmission mechanism 20 is disposed in the transmission case 10, wherein a power unit 21 is connected with a transmission gear set 22 to drive a driving wheel 23 and a driving wheel shaft set 24. The driving wheel 23 is used to drive the main body 60 to move. A wheel shaft 231 of the driving wheel 23 is disposed with a light rotarily controlling cam 232 at the top for intermittently pressing and controlling a light triggering leaf spring 233 during rotation so as to trigger a flickering light of the main body 60. The driving wheel shaft set 24 includes a transmission shaft 25 on which a laterally pushing wheel 26, driving main gear 27, a lifting unit pressing cam 28 and a stepped cam 29 disposed on an outer side of a rear end of the transmission case 10 are mounted in a rearward sequency. Two leading pushing plates 261, 262 are oppositely disposed at rim portions of the laterally pushing wheel 26 so as to leadingly drive the laterally pushing unit 40. The transmission main gear 27 is connected with the transmission gear set 22 for inputting power. The lifting unit pressing cam 28 is used to press and control the 1 if ting unit 50. The stepped cam 29 has multiple steps of projecting plates 291, 292 for steppedly pressing and controlling the forward pushing unit 30.

The forward pushing unit 30 is composed of a forward pushing leading member 31 and a forward extending member 32. The forward pushing leading member 31 is longitudinally disposed above the transmission case 10. A front and a rear guiding slots 311, 312 are disposed on the leading member 31. A guiding rib 313 is disposed at a rear end thereof and a hooking slot 314 is formed on a front end thereof. A hooking boss 315 is disposed in front of the rear guiding slot 312. The leading member 31 is guided by two guiding bosses 63, 64 of the main body 60 located within the guiding slots 311, 312 and the guiding rib 313 is slidably guided by the guiding rib 121 of the transmission case 10. The rear end thereof is leant on the projecting plates 291, 292 of the stepped cam 29 of the driving wheel shaft set 24 and rotarily pressed thereby to slide back and forth. A compression spring 316 is disposed between the hooking boss 315 and the guiding boss 64. The forward extending member is hooked in the hooking slot 314. The forward extending member 32 includes a forward extending seat 321 having a lower end pivotally connected with the main body 60, an upper end formed with a front extending decorative member 322 (a missile in this embodiment), and a middle section pivotally connected with the hooking slot 314 of the forward pushing leading member 31.

The laterally pushing unit 40 is outward pushed and extended by means of a first laterally pushing member 41 and a second laterally pushing member 42 respectively passing through the slots 132, 142 of the transmission case 10. The first laterally pushing member 41 has a rear leaded end 411 which is pushed by the leading plate 261 (or 262) of the laterally pushing wheel 26 to extend outward. A restricting plate 412 is used to press a compression spring 413 disposed between the inner wall of the transmission case 10 and the restricting plate 412. The second laterally pushing plate 42 has an extending post 421 extending through the bottom end of the slot 142 and located on the rest portion 144 thereof. A reverse hooking portion 422 is disposed at the rear end for hooking the inner wall of the case 10. A guiding plate 423 inclinedly extends from an upper portion of the extending post 421. The upper end thereof is formed with a leaded end 424 which is pushed by the leading plate 262 (or 261) of the laterally pushing wheel 26 to outward extend. The front end thereof is formed with a hooking portion 425 for one end of the compression spring 426 to hook thereon. The other end is hooked on the hooking portion 146 of the slot 142.

The lifting unit 50 has a pressed support 51 for bearing the intermittent rotary pressing of the pressing cam 28 of the driving wheel shaft set 24. A leading gear 52 is pivotally connected therein and a pushing lifting post 53 is concentrically linked therewith. A bottom end of the pushing lifting post is formed with a plane tray. A compression 55 is disposed between a bottom of the pressed support 51 and the inner bottom face of the case 10. The pushing lifting post 53 passes through the through hole 15 of the case 10 to outward extend under the chassis. Two guiding keys 511 are formed on lateral walls of the pressed support 51 and slidably located in the guiding slots 131, 141 of the case 10.

The front hood 61 is pivotally disposed on the front side of the main body 60, having a bottom pivot so that when pushed by the forward pushing unit 30, the front hood 61 is pivoted forward to expose the front decorative member 322. The lateral hood 62 is pivotally connected with the lateral wall of the main body 60 at bottom end so that when pushed by the laterally pushing unit 40, the lateral hood 62 is pivoted laterally to expose the lateral decorative members 133, 143 disposed on lateral walls of the case 10.

When the transmission unit 21 inputs power, the transmission gear set 22 drives the driving gear set 24 and the laterally pushing wheel 26, lifting seat pressing cam 28 and stepped cam 29 respectively drive the laterally pushing unit 40, lifting unit 50 and forward pushing unit 30 at different time so that each time the main body 60 runs through a certain distance, the forward pushing unit 30 forward pivots the front hood 61 or the laterally pushing unit 40 laterally pivots the lateral hoods 62 to display the front decorative member 322 and lateral decorative members 133, 143. Also, when the pressing cam 28 presses the lifting unit 50, the pushing lifting post 53 thereof extends outward to lift the main body 60. When the leading gear 52 is driven by the transmission gear set 22, the main body 60 is lifted and rotated. After the pressing force is removed, the lifting unit 50 is retracted by the compression spring and the main body 60 descends and restores to run.

The above embodiment is only an example of the present invention. Any derivation or modification thereof should fall within the scope of the present invention.

What is claimed is:

1. A transmission mechanism of a toy motorcycle, comprising:

a transmission case, a transmission mechanism, a forward pushing unit, a laterally pushing unit, a lifting unit, a front hood pivotally disposed on a front side of a main body, and two lateral hoods pivotally disposed on two lateral sides of the main body, wherein;

the transmission case is mounted on a chassis of the main body;

the transmission mechanism is disposed in the transmission case and a power unit is connected with a transmission gear set to drive a driving wheel and a driving wheel shaft set, the driving wheel shaft set including a transmission shaft on which a laterally pushing wheel, a driving main gear, a lifting unit pressing cam, and a stepped cam disposed on an outer side of a rear end of the transmission case are mounted in sequence, a transmission main gear being connected with the transmission gear set for inputting power, the laterally pushing wheel being used to laterally drive the laterally pushing unit, the lifting unit pressing cam being used to press and control the lifting unit;

the forward pushing unit is composed of a forward pushing leading member and a forward extending member, the forward pushing leading member being longitudinally disposed above the transmission case, the rear end thereof being pushed by the stepped cam to slide back and forth, whereby when extending forward, the front hood is pushed and pivoted forward and outward;

the laterally pushing unit includes at least one laterally pushing member passing through a slot of the transmission case, the laterally pushing member being pushed by the laterally pushing wheel to extend laterally and outward so as to laterally and outward push and pivot the lateral hoods;

the lifting unit has a pressed support for bearing an intermittent rotary pressing of the pressing cam, a pushing lifting post being concentrically linked therewith, a bottom end of the pushing lifting post being formed with a plane tray, the pushing lifting post passing through a through hole of the case to extend outward under the chassis, whereby when pressed, the pushing lifting post extends downward to lift up the main body and when the pressing force is removed, the main body descends.

2. A transmission mechanism as claimed in claim 1, wherein:

a bearing hole is formed on a rear wall of the transmission case for mounting a rotary shaft of the driving wheel shaft set, a guiding slot being disposed on a rear section of at least one lateral wall of the transmission case to guide the lifting unit, a notch being formed on a middle section of at least one lateral wall of the transmission case to receive the laterally pushing unit, a decorative member being disposed on the lateral wall of the transmission case in front of the notch, a through hole being formed on a bottom wall of the transmission case for the lifting unit to extend therethrough.

3. A transmission mechanism as claimed in claim 2, wherein:

the lateral wall of the transmission case that includes the notch has an outward extending rest portion beneath the notch, the lateral wall of the transmission case that includes the notch further includes a middle guiding slot and a hook portion at an upper end thereof.

4. A transmission mechanism as claimed in claim 1, wherein:

two arched leading pushing plates are oppositely disposed near a periphery of the laterally pushing wheel.

5. A transmission mechanism as claimed in claim 1, wherein the stepped cam has multiple steps of projecting plates for steppedly pressing and controlling the forward pushing unit.

6. A transmission mechanism as claimed in claim 1, wherein:

a front guiding slot and a rear guiding slot are disposed on a leading member of the forward pushing unit, a guiding rib being disposed at a rear end thereof and a hooking slot being formed on a front end thereof, a hooking boss being disposed in front of the rear guiding slot, the leading member being guided by a first guiding boss and a second guiding boss of the main body located within the guiding slots and the guiding rib being slidably guided by a guiding rib of the transmission case, a compression spring being hooked between the hooking boss and the first guiding boss.

7. A transmission mechanism as claimed in claim 6, wherein a middle section of the forward extending member is hooked in the hooking slot of the leading member, the forward extending member including a forward extending seat having a lower end pivotally connected with the main body and an upper end formed with a front extending decorative member.

8. A transmission mechanism as claimed in claim 1, wherein:

two notches are formed on the lateral walls of the transmission case and the laterally pushing unit includes a first laterally pushing member and a second laterally pushing member respectively passing through the notches on the lateral walls of the transmission case, the first laterally pushing member having a rear end which is pushed by the leading plate of the laterally pushing wheel to extend outward, a restricting plate being used to press a compression spring disposed between the inner wall of the transmission case and the restricting plate, the second laterally pushing plate having an extending post extending through the bottom end of the notch, a reverse hooking portion being disposed at a rear end for hooking the inner wall of the case, an inclined guiding plate extending from an upper portion of the extending post, the front end of the guiding plate being formed with a hooking portion for one end of the compression spring to hook thereon, the other end of the compression spring being hooked on the hooking portion of the notch.

9. A transmission mechanism as claimed in claim 1, wherein:

the lifting unit has a pressed support and a leading gear is pivotally connected therein, a pushing lifting post being concentrically linked therewith and extending out of the transmission case, a bottom end of the pushing lifting post being formed with a plane tray, a compression spring being disposed between a bottom of the pressed support and an inner bottom face of the case, whereby when the lifting unit is pressed down, the leading gear meshes with the transmission gear set to rotate the main body.

* * * * *